US005463948A

United States Patent [19]

Newman

[11] Patent Number: 5,463,948

[45] Date of Patent: Nov. 7, 1995

[54] MUG IMPRINTING ROLLER FRAME

[75] Inventor: Donald E. Newman, Wyncote, Pa.

[73] Assignee: Stretch Devices, Inc., Philadelphia, Pa.

[21] Appl. No.: 143,792

[22] Filed: Oct. 26, 1993

[51] Int. Cl.[6] ..... B41L 13/02

[52] U.S. Cl. ..... 101/127.1; 101/38.1; 38/102.91

[58] Field of Search ..... 101/38.1, 127, 101/127.1, 128, 128.1; 38/102.1–102.91; 160/378, 395, 397

[56] References Cited

U.S. PATENT DOCUMENTS

| | | | |
|---|---|---|---|
| 2,566,919 | 9/1951 | Black et al. | 101/127.1 X |
| 3,273,497 | 9/1966 | Rosema | 101/128.1 |
| 3,908,293 | 9/1975 | Newman | 38/102.91 |
| 4,430,815 | 2/1984 | Wulc | 38/102.91 |
| 4,525,909 | 7/1985 | Newman | 101/127.1 X |
| 5,127,176 | 7/1992 | Newman | 101/127.1 X |

OTHER PUBLICATIONS

Advertisement from Stretch Devices, Inc. (1983).

*Primary Examiner*—Chris A. Bennett

*Attorney, Agent, or Firm*—Seidel Gonda Lavorgna & Monaco

[57] ABSTRACT

A curved item printing apparatus has a screen tensioning and printing frame. The frame has a plurality of tensioning devices coupled together by corner members which support the tensioning devices for rotation about their longitudinal axis. Each tensioning device has a screen retainer for retaining an edge portion of a screen fabric. At least one of the tensioning means is a thin edge retainer having a screen engagement edge, a screen engaging surface for directing the screen and a thin edge surface. The screen engaging surface and the thin edge surface converge at the screen engaging end. The perpendicular distance between the longitudinal axis of the thin edge retainer and the thin edge surface is less than the distance between the longitudinal axis and the screen engaging edge.

11 Claims, 3 Drawing Sheets

MUG IMPRINTING ROLLER FRAME

FIELD OF THE INVENTION

This invention relates to a roller frame and mesh and particularly to a roller frame and mesh having rotatable thin edge retainers for tensioning a screen containing an image and allowing imprinting of a larger image area on a mug.

BACKGROUND OF THE INVENTION

There are several techniques for placing an image on a mug or a cup having a handle. One of the techniques used to produce an image on the mug or cup is to use screen printing. Conventional screen printing is accomplished by having a wooden frame wherein a pair of wooden slats are spaced apart such that each lower edge is parallel to the other and the slats angle away from each other as they project upward. The mesh is secured by gluing to the lower and outer edges of the slats. The other two sides of the mesh are secured to the wooden frame. The tension on the screen is minimal, typically one to seven newtons per centimeter. The frame is sized so that the handle of the mug goes from the outer edge of one slat to the outer edge of the other slat as the mug rotates to receive the image. The image is transferred to the mug by a squeegee exerting pressure on the screen, pressing ink through the screen. In conventional screens, the screen engages the mug and the image transfers. The screen separates from the mug after the squeegee passes due to the tension in the screen causing the screen to snap back.

One shortcoming of conventional screens is that because of the low tensions, the squeegee must be moved a sufficient distance past the image on the screen to ensure that the screen snaps back away from the mug or cup. In addition, the deflection of the screen by the squeegee is typically in excess of ¼ inch because of the low tension on the screen. As indicated above, the screen has to be sized to the mug or cup, and therefore the image is limited in size because the slats are a set distance based on the mug and the image must be spaced sufficiently from the slat to permit the squeegee to pass the image and the screen to snap back.

High tension screens, such as the Newman Roller Mesh®, have rollers for tensioning the screen. The higher tension resulting from use of the rollers results in the screen not deforming as much as conventional screens, therein the squeegee does not have to pass the image by as great a distance for proper snap back thus resulting in a crisper image. However, the rollers engage the handle and prohibit the mug or cup from rotating through a complete rotation as desired and the roller projects inward toward the image portion of the screen from a point where the screen engages the roller therein reducing the space for the squeegee and resulting in a smaller image.

It is desired to have an apparatus and method for printing on a curved surface such as a mug, or cup wherein the screen is held at high tension and allows an image to be printed on a large portion of the mug or cup.

SUMMARY OF THE INVENTION

The present invention relates to a curved item printing apparatus having a screen tensioning and printing frame. The frame has a plurality of tensioning devices coupled together by corner members which support the tensioning devices for rotation about their longitudinal axis. Each tensioning device has a screen retainer for retaining an edge portion of a screen fabric. At least one of the tensioning means is a thin edge retainer having a screen engagement edge, a screen engaging surface for directing the screen and a thin edge surface. The screen engaging surface and the thin edge surface converge at the screen engaging end. The perpendicular distance between the longitudinal axis of the thin edge retainer and the thin edge surface is less than the distance between the longitudinal axis and the screen engaging edge.

One object, feature and advantage resides in the provision of a thin edge retainer having a screen engaging edge, a screen engaging surface for directing the screen and a thin edge surface wherein the perpendicular distance between the longitudinal axis of the thin edge retainer and the thin edge surface is less than the distance between the longitudinal axis and the screen engaging edge therein creating a space for the squeegee and allowing for a larger image area.

Another object, feature and advantage resides in the provision of the thin edge surface and the screen engaging edge forming an angle in the range of 30° to 60° therein allowing maximum rotation of the handle of the mug without interference.

Further objects, features and advantages of the present invention will become more apparent to those skilled in the art as the nature of the invention is better understood from the accompanying drawings and detailed descriptions.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
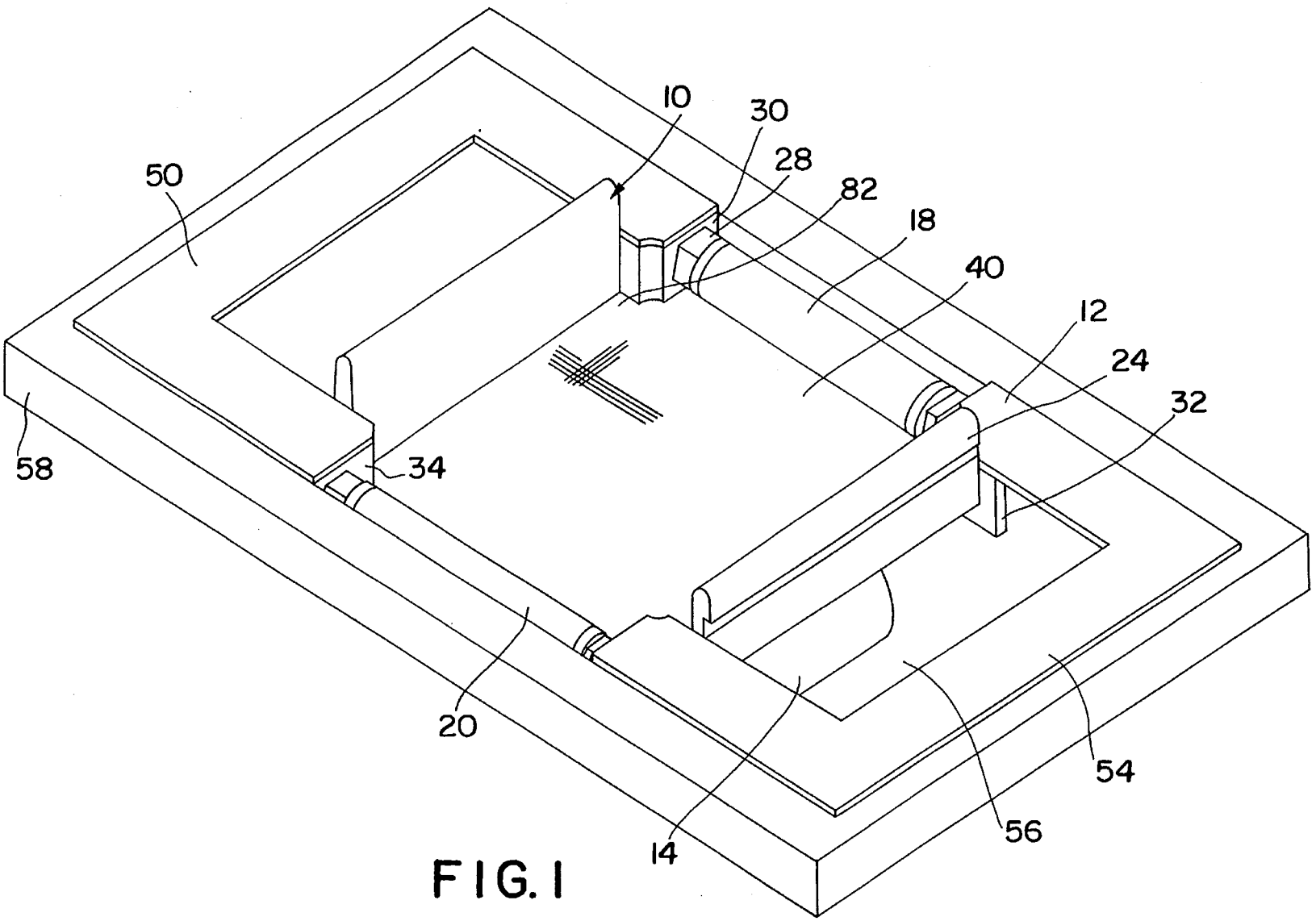
FIG. 1 is a perspective view of a screen frame for printing a mug having a pair of thin edge retainers.

Referring to the drawings in detail, where like numerals indicate like elements, there is illustrated a device in accordance with the present invention designated generally as 10. Referring to FIG. 1, a printer frame 12 for printing a mug 14 or other curved objects having a handle 16 or other projection has four tensioning devices 18, 20, 22 and 24.

Figure 2:
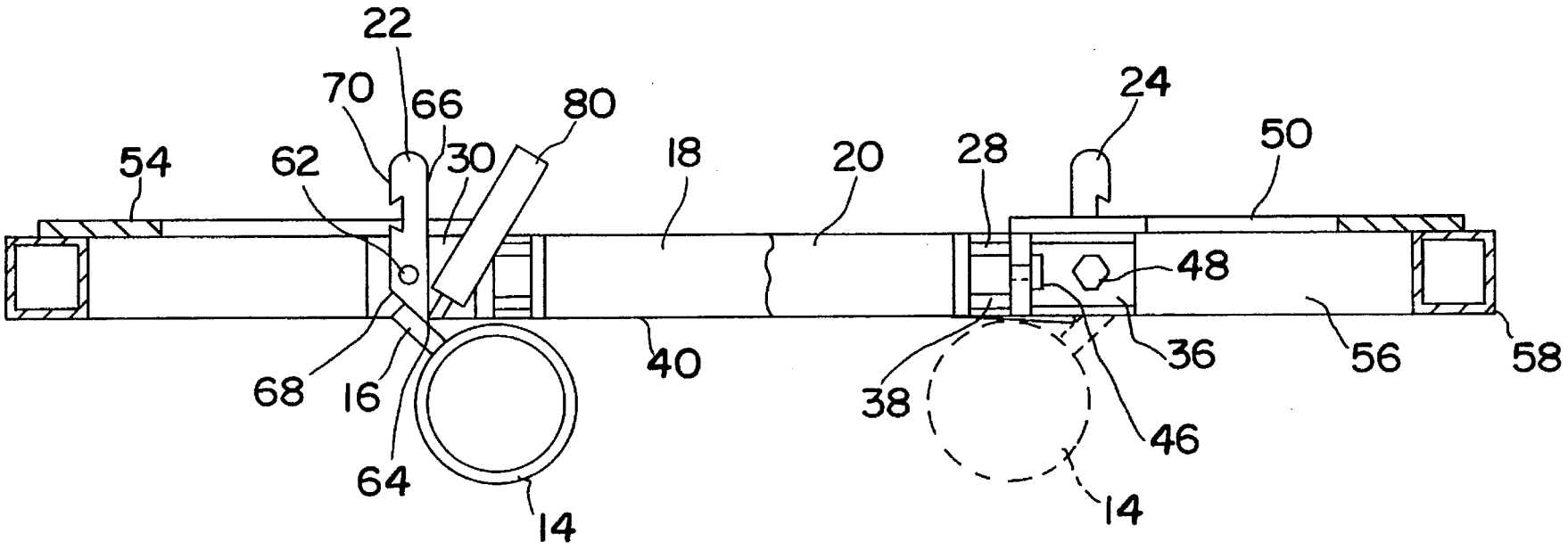
FIG. 2 is a section view of the screen frame showing the pair of thin edge retainer and the mug. The mug is shown in the rotated position in phantom.

Two of the tensioning devices are rollers 18 and 20 that extend parallel to each other and are spaced apart. Each roller has a pair of end plugs 28. The rollers 18 and 20 each extend between two distinct corner members 30 and 32, and 34 and 36 (corner member 36 shown in FIG. 2) wherein a portion of the end plug 28 is received by a hole 38 in the corner member 36 as seen in FIG. 2. A bolt 46, only one shown in FIG. 2, extends through the hole 38, shown in hidden line, in the corner member 36 and is received by the end plug 28. The rollers 18 and 20 are rotatably supported by the corner members 30, 32 and 34 for rotation about their own longitudinal axis. The rollers 18 and 20 rotate to tension a screen or mesh 40 containing an image and are secured in a predetermined tensioned position. U.S. Pat. No. 5,127,176 discloses a similar construction of the rollers and the corner members and is herein incorporated by reference.

The other two tensioning devices are a pair of thin edge retainers 22 and 24. The thin edge retainers 22 and 24 are spaced apart and extend parallel to each other. The thin edge retainers 22 and 24 extend between the corner members 30 and 34, and 32 and 36 such that the rollers 18 and 20 and the thin edge retainers 22 and 24 define a rectangular shape. The thin edge retainers 22 and 24 are each secured to the corner members by a pair of bolts 48 (one shown in FIG. 2) and rotate about their own longitudinal axis defined by the bolts. The rotation of the thin edge retainers 22 and 24 in tensioning the screen will be described in greater detail below.

A pair of "U" shaped plates 50 are secured to the corner members 30, 32 and 34 by bolts. A base 54 of each plate 50 is spaced from the thin edge retainers 22 and 24 therein defining a space 56 to receive the handle 16 of the mug 14. The plates 50 are secured to an outer frame 58 of the printer frame 12, therein the rollers 18 and 20 are in proximity to the outer frame 56 and the thin edge retainers are spaced by the "U" shaped plates 50.

Referring to FIG. 2, the thin edge retainers 22 and 24 are similar, so only one thin edge retainer 22 will be described in detail. The thin edge retainer 22 has a threaded hole 62 to receive the bolt 48 and define the longitudinal axis of the thin edge retainer 22. The bolt 48 received by the threaded hole 62 secures the thin edge retainer 22 in the predetermined tensioned position.

Figure 3:
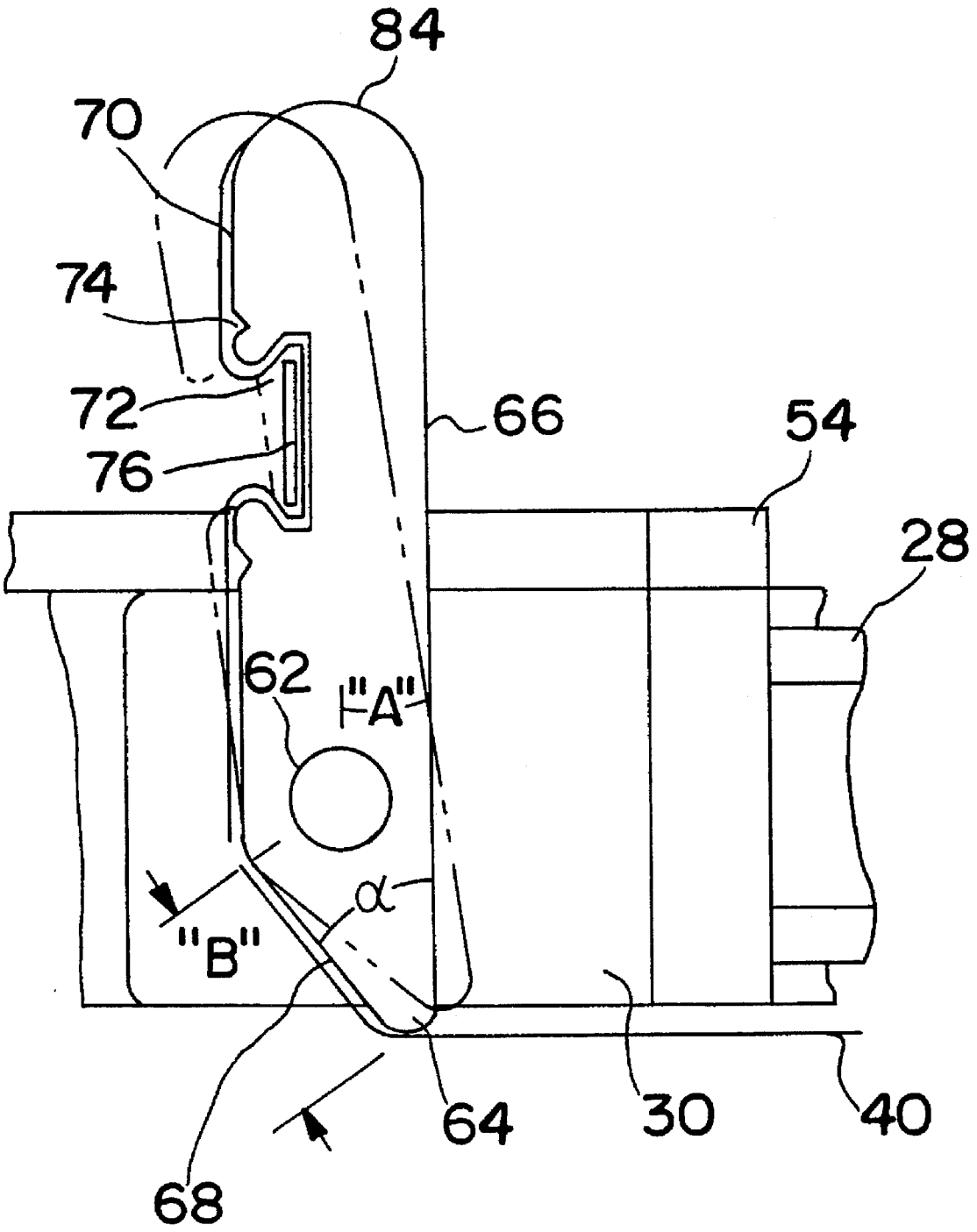
FIG. 3 is an enlarged view of the thin edge retainer. The thin edge retainer is shown in a pretension tension position in phantom.

The thin edge retainer 22 has a screen engaging edge 64 which extends parallel to the longitudinal axis and where the screen 40, containing the image, first engages the thin edge retainer 22. A thin edge surface 66 of the thin edge retainer 22, adjacent to the screen engaging edge 64, faces the image surface of the screen 40. The distance "A" from the thin edge surface 66 to the hole 62 (the longitudinal axis) along the normal of the thin edge surface 66 is less than the distance "B" from the screen engaging edge 64 to the hole 62 (as best seen in FIG. 3). In the preferred embodiment, the ratio of the "A" to "B" is approximately 0.4.

The thin edge retainer 22 has a screen engaging surface 68 adjacent to the screen engaging edge 64. The screen engaging edge 64 and the thin edge surface 66 form an angle $\alpha$ of between 30° to 60° and preferably 45°. The screen engaging edge*64 is angled so that as the mug 14 rotates, the screen engaging edge 64 does not interfere with the handle 16 of the mug 14.

In addition, the thin edge retainer has a screen retainer 70 surface having a locking groove 72 and a pair: of registration grooves 74. The locking groove 72 receives a locking strip 76 for retaining the screen 40. The rollers 18 and 20, similarly, have locking grooves and registration grooves on their curved outer surface. U.S. Pat. No. 4,525,909 discloses a roller having similar locking grooves and registration grooves and is herein incorporated by reference.

Referring to FIG. 2, a squeegee 80 moves across the screen 40 to push ink through the image in the screen 40 wherein the screen opposes the force of the squeegee. The screen 40 is pressed downward in proximity to the mug 14 (or printing substrate) to an off contact distance of approximately 1/64 of inch by the squeegee 80 as the squeegee 80 strokes. The tension in the screen 40 prevents the screen 40 from making contact with the mug 14 and causes the squeegee 80 to push the ink through the screen 40. As the squeegee 80 passes over the screen 40, the screen 40 snaps back from the mug 14 leaving a clear sharp image.

A space 82 defined in proximity to the thin edge surface 66 of the thin edge retainer 22 and outward of the image on the screen 40 receives the squeegee 80 to allow the squeegee 80 to pass the image and the screen 40 to snap back. The thin edge surface 66 of the thin edge retainer 22 creates the space 82 for the squeegee 80 as compared to a tensioning roller, in that the normal distance "A" from the thin edge surface 66 to the longitudinal axis of the thin edge retainer 22 (i.e. the hole) is less than distance "B" between the screen engaging edge 64 and the longitudinal axis.

Referring to FIG. 3, in operation the thin edge retainers 22 are loosened and rotated to a screen attached and low tension position as shown in phantom. The screen 40 is attached to the printer frame 12 by placing the screen 40 in the locking grooves 72 and receiving the locking strip 76. The tensioning devices including the tensioning rollers 18 and 20 and the thin edge retainers 22 and 24 are rotated to tension the screen to the desired tension. The screen attached and low tension position is determined so that upon rotation of the thin edge retainers 22 and 24, the thin edge surface 66 will be substantially perpendicular to the screen 40 and the screen engaging edges 64 are substantially on the same plane as the line where the screen engages the roller 18 and 20.

The thin edge retainer 22 has a tensioning handle edge 84 which is curved to facilitate the gripping to tension the screen 40 and, in addition, to prevent tearing of a screen on another printer frame when the printer frame 12 are stacked.

After the screen 40 has been tensioned properly, a stencil containing the image is adhered to the screen 40 by conventional means. The "U" shaped plates 50 are secured to the outer frame 58 of the printer frame 12.

The squeegee 80 is placed in proximity to one of the thin edge retainers and pushed against the screen. The squeegee 80 is dragged across the screen 40 in synchronization with the rotation of the mug 14 so that the tip of the squeegee 80 is above the mug. Ink which has been previously placed on the screen in front of the squeegee is forced through the screen 40 by the squeegee 80 and onto the mug 14.

The present invention may be embodied in other specific forms without departing from the spirit or essential attributes thereof and, accordingly, reference should be made to the appended claims, rather than to the foregoing specification, as indicating the scope of the invention.

I claim:

1. A curved item priming apparatus for receiving a screen fabric having a plurality of edge portions comprising: a screen tensioning and printing frame; the frame having a plurality of tensioning means coupled together by corner members which support the tensioning means, each tensioning means having a longitudinal axis, each tensioning means having means for rotating about the tensioning means' longitudinal axis; each tensioning means having a screen retaining means for retaining one of the edge portions of the screen fabric; and at least one of the tensioning means having a screen engaging edge, a screen engaging surface for directing the fabric and a thin edge surface, the screen engaging surface and the thin edge surface converging at the screen engaging edge wherein the screen engaging edge is parallel to the longitudinal axis of the tensioning means and the perpendicular distance between the longitudinal axis and the thin edge surface is less than the distance between the longitudinal axis and the screen engaging edge.

2. An apparatus as in claim 1 wherein an angle formed between the thin edge surface and the screen engaging surface is in the range of 30° to 60°.

3. An apparatus as in claim 1 wherein the one of the tensioning means has a pair of parallel sides wherein the thin edge surface is one of the parallel sides and the screen retaining means is located on the other parallel side.

4. An apparatus as in claim 3 wherein the thin edge retainer has a tension handle edge which is opposite the screen engaging surface and has a curved surface.

5. An apparatus for tensioning a screen fabric having a plurality of edge portions and priming on an article, the apparatus comprising: four corner members, a pair of tensioning means, each tensioning means extending between two distinct comer members, a pair of thin edge tensioning means, each thin edge tensioning means extending between corner members spacing the tensioning means, the tensioning means and the thin edge tensioning means each having a longitudinal axis extending between corner members, each of the tensioning means and the thin edge tensioning means having means for rotating about its longitudinal axis; the tensioning means and the thin edge tensioning means each having a longitudinally extending channel on its periphery, a retainer for each channel to retain an edge portion of a screen fabric in each channel, means associated with each comer member for locking each tensioning means and thin edge tensioning means in a predetermined rotative position so that a desired tension may be applied to a screen fabric, and each tensioning means and thin edge tensioning means having a screen retaining means for retaining one of the edge portions of the screen fabric, at least one of the thin edge tensioning means having a screen engaging edge, a screen engaging surface for directing the fabric and a thin edge surface, the screen engaging surface and the thin edge surface converging at the screen engaging edge wherein the screen engaging edge is parallel to the longitudinal axis of the thin edge tensioning means and the perpendicular distance between the longitudinal axis and the thin edge surface is less than the distance between the longitudinal axis and the screen engaging edge.

6. An apparatus as in claim 5 wherein an angle formed between the thin edge surface and the screen engaging surface is in the range of 30° to 60°.

7. An apparatus for tensioning a screen fabric having a plurality of edge portions and priming on an article, the apparatus comprising: four corner members, a pair of rollers, each roller extending between two distinct corner members, a pair of thin edge retainers, each thin edge retainer extending between corner members spacing the rollers, the rollers and the thin edge retainers each having a longitudinal axis extending between corner members, each roller and thin edge retainer having means for rotating about its longitudinal axis; the rollers and the thin edge retainers each having a longitudinally extending channel on its periphery, a retainer for each channel to retain an edge portion of a screen fabric in each channel, means associated with each corner member for locking each roller in a predetermined rotative position so that a desired tension may be applied to a screen fabric, and each roller and thin edge retainer having a screen retaining means for retaining one of the edge portions of the screen fabric, the thin edge retainers each having a screen engaging edge, a screen engaging surface for directing the fabric and a thin edge surface, the screen engaging surface and the thin edge surface converging at the screen engaging edge wherein the screen engaging edge is parallel to the longitudinal axis of the thin edge retainer and the perpendicular distance between the longitudinal axis and the thin edge surface is less than the distance between the longitudinal axis and the screen engaging edge.

8. An apparatus as in claim 7 wherein an angle formed between the thin edge surface and the screen engaging surface of the thin edge retainer is in the range of 30° to 60°.

9. An apparatus as in claim 7 wherein the thin edge retainers each have a pair of parallel sides wherein the thin edge surface is one of the parallel sides and the screen retaining means is located on the other parallel side.

10. An apparatus as in claim 9 wherein the thin edge retainer has a tension handle edge which is opposite the screen engaging surface and has a curved surface.

11. A retainer for tensioning a screen for printing a curved surface comprising: a screen engaging edge for engaging the printing screen; a screen engaging surface adjacent the screen engaging edge for directing the fabric; a thin edge surface, the screen engaging surface and the thin edge surface converging at the screen engaging edge; and a longitudinal axis, the retainer having means for rotating about its longitudinal axis wherein the screen engaging edge is parallel to the longitudinal axis of the tensioning means and the perpendicular distance between the longitudinal axis and the thin edge surface is less than the distance between the longitudinal axis and the screen engaging edge.

* * * * *